US008452198B2

(12) United States Patent
Furukawa

(10) Patent No.: US 8,452,198 B2
(45) Date of Patent: May 28, 2013

(54) IMAGE FORMING APPARATUS

(75) Inventor: Toshio Furukawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 801 days.

(21) Appl. No.: 12/620,192

(22) Filed: Nov. 17, 2009

(65) Prior Publication Data

US 2010/0124430 A1 May 20, 2010

(30) Foreign Application Priority Data

Nov. 17, 2008 (JP) ..... 2008-293592

(51) Int. Cl.
*G03G 21/00* (2006.01)
*G03G 15/00* (2006.01)

(52) U.S. Cl.
USPC ..... 399/34; 399/71

(58) Field of Classification Search
USPC ..... 399/71, 34, 302
See application file for complete search history.

(56) References Cited

U.S. PATENT DOCUMENTS

2007/0036578 A1 2/2007 Fukami et al.
2008/0019723 A1 1/2008 Naganawa et al.
2010/0111557 A1* 5/2010 Maruyama ..... 399/71

FOREIGN PATENT DOCUMENTS

JP 2004-109386 4/2004
JP 2007-041348 2/2007
JP 2008-009294 1/2008

* cited by examiner

*Primary Examiner* — David Gray
*Assistant Examiner* — Erika J Villaluna
(74) *Attorney, Agent, or Firm* — Banner & Witcoff, Ltd.

(57) ABSTRACT

An Image Forming Apparatus has a controller for controlling a second bias, which is applied to a cleaning member, based on a value of electric current measured by a current sensor. The controller controls the second bias on based on the value of the current measured when a predetermined measurement range of a transport belt is in contact with the cleaning member. The measurement range is a range in which conditions, under which the first bias and the second bias are applied, are identical.

15 Claims, 20 Drawing Sheets

IMAGE FORMING APPARATUS

CROSS REFERENCE TO RELATED APPLICATION

The present application claims priority from Japanese Patent Application NO. 2008-293592, which was filed on Nov. 17, 2008, the disclosure of which is incorporated herein by reference in its entirety.

BACKGROUND OF THE INVENTION

The present invention relates to an image forming apparatus having a belt and a cleaning member for the belt.

Image forming apparatuses are known in which a recording sheet for forming an image thereon is transported by a belt. In such an Image Forming Apparatus, a cleaning member for the belt is provided to remove developer and paper dust attached to the belt. In terms of the configurations adopted for the cleaning members, the cleaning member is adapted to scrape off the developer by coming into contact with the belt, or by applying a bias to the belt to electrically separate the developer from the belt.

For example, in a related art, a bias is applied between the belt and the cleaning member to thereby remove the developer from the belt. Further, by focusing attention on the fact that the state of such as the surface of the belt changes due to the aging deterioration and fouling, the voltage between a back roller disposed on the back side of the belt and a first obverse member disposed on the obverse side of the belt is subjected to constant current control so as to maintain satisfactory cleaning performance irrespective of the state of the belt. Additionally, for the purpose of this constant current control, the magnitude of the electric current flowing between the back roller and the first obverse member is measured, and the magnitude of the voltage between the back roller and the first obverse member is changed on the basis of the measured magnitude of the current.

However, according to studies conducted by the present inventors, it has become clear that even if the current is constant, the cleaning performance does not necessarily become consistent and an optimum cleaning bias changes due to changes in the environment and due to the aging and use of the cleaning member and the belt. As a method for detecting these changes, a method of estimating these changes on the basis of a resistance value at the time of the cleaning as been proposed. However, it is necessary to accurately measure the resistance value of the belt. Specifically, it is essential to accurately detect the current through the belt. However, it has also become clear that if the current is measured while a predetermined voltage is being applied between the cleaning member and the belt, the current varies based on the measuring position of the belt. Specifically, a bias is applied between the belt and the cleaning member, and a bias is also applied between the belt and each of a process unit and a transfer member, each disposed opposite the belt to effect image formation. These biases form a charged state corresponding to the biases applied to the belt surface, and this charged state affects the magnitude of the current flowing between the cleaning member and the belt during cleaning. Additionally, a similar problem occurs not only in the belt for transporting the recording sheet but also in an intermediate transfer belt for temporarily holding a toner image.

SUMMARY OF THE INVENTION

Accordingly, an object of the invention is to provide an image forming apparatus in which the recording sheet is transported by the belt, and which makes it possible to improve the cleaning performance of the belt by accurately reflecting the state of the belt based on the bias of the cleaning member.

To attain the above object, in accordance with an aspect of the invention there is provided an image forming apparatus comprising: an endless belt; image carriers juxtaposed along an outer peripheral surface of the belt; transfer members which are respectively provided in correspondence with the image carriers, which are respectively disposed opposite the image carriers with the belt interposed therebetween, and to which a first bias is applied; a cleaning member disposed in contact with the outer peripheral surface of the belt; a current sensor for measuring a value of electric current flowing across the cleaning member; and a controller for controlling a second bias, which is applied to the cleaning member based on of the value of the electric current measured by the current sensor, wherein the controller controls the second bias based on the value of the electric current measured when a predetermined measurement range of the belt is in contact with the cleaning member, and wherein the measurement range is a range in which conditions under which the first bias and the second bias are applied are identical.

In accordance with another aspect of the invention, there is provided a method of controlling an image forming apparatus which comprises: an endless belt; a plurality of image carriers juxtaposed along an outer peripheral surface of the belt; a plurality of transfer members which are respectively provided in correspondence with the image carriers, which are respectively disposed opposite the image carriers with the belt interposed therebetween, and to which a first bias is applied; and a cleaning member disposed in contact with the outer peripheral surface of the belt, the method comprising:

measuring a value of electric current flowing across the cleaning member; and controlling a second bias, which is applied to the cleaning member based on the measured value of the electric current when a predetermined measurement range of the belt is in contact with the cleaning member wherein the measurement range is a range in which conditions under which the first bias and the second bias are applied are identical.

DETAIL DESCRIPTION OF EXEMPLARY EMBODIMENTS

Figure 1:
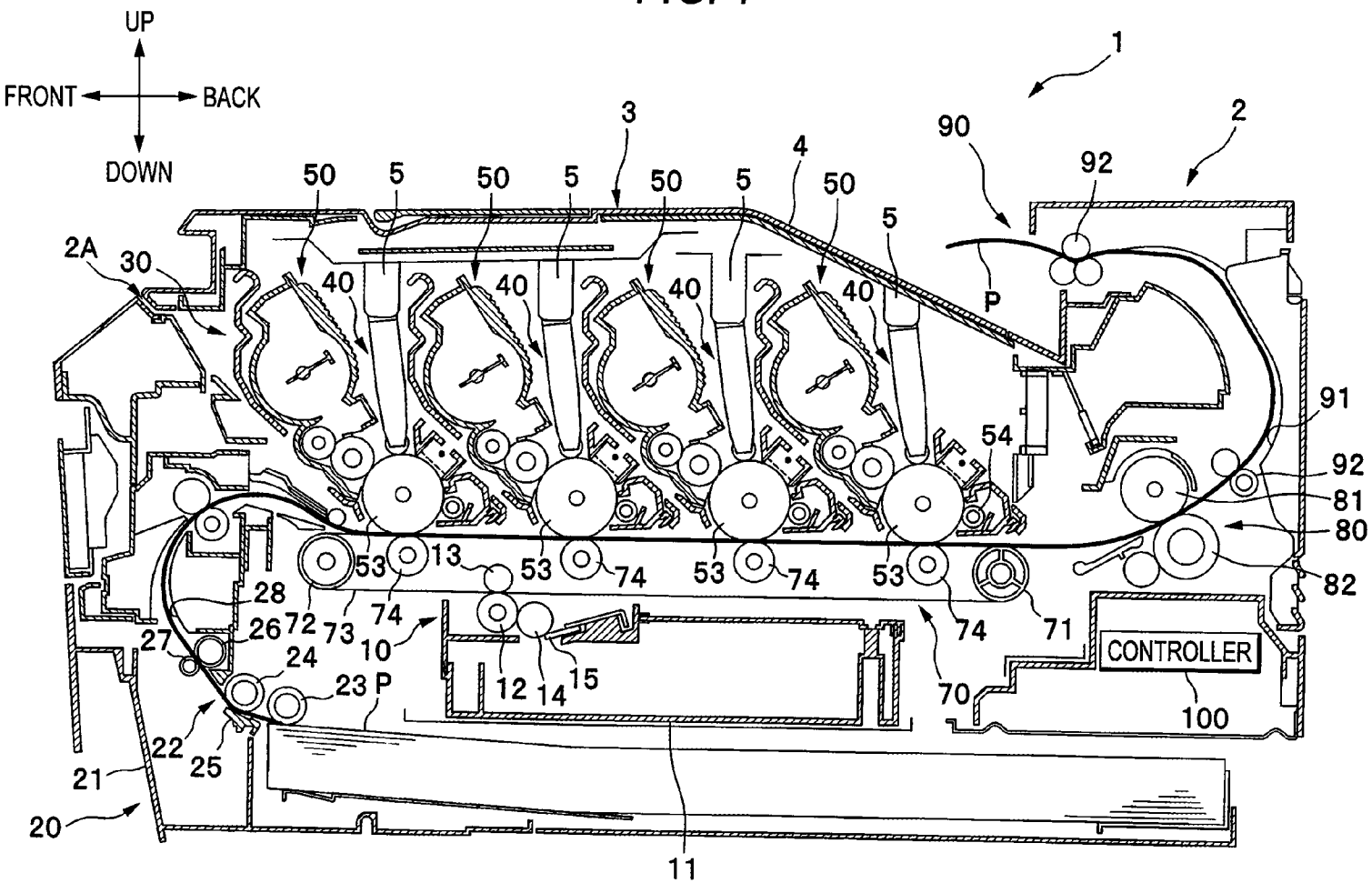
FIG. 1 is a cross-sectional view illustrating an overall configuration of a color printer as an exemplary embodiment of an image forming apparatus.

Next, a detailed description of exemplary embodiments of the present invention with reference to the accompanying drawings will be given. It should be noted that, in the following description, after the overall configuration of the color printer is first described, the details of the exemplary embodiment of the present invention will be described.

In the following description, the description of directions will be given in terms of directions based on the user at the time of using the color printer. Namely, it is assumed that in FIG. 1, when facing the drawing, the left side is the "front side," the right side is the "back side," the farther side is the "left side," and the nearer side is the "right side." Further, it is assumed that, facing the drawing, the vertical direction is the "vertical direction."

As shown in FIG. 1, a color printer 1 comprises an apparatus body 2, a sheet feeding section 20 for feeding a sheet P; an image forming section 30 for forming an image on the fed sheet P; a sheet discharging section 90 for discharging the sheet P with the image formed thereon; and a controller 100.

An opening 2A is formed in an upper portion of the apparatus body 2. This opening 2A is adapted to be opened and closed by an upper cover 3, which is rotatably supported by the apparatus body 2. The upper surface of the upper cover 3 serves as a sheet discharging tray 4 for accumulating the sheets P discharged from the apparatus body 2, and a plurality of LED mounting members 5 for holding below-described LED units 40, are provided on the lower surface thereof.

The sheet feeding section 20 is provided in a lower portion inside the apparatus body 2, and mainly includes a sheet feeding tray 21, which is detachably installed in the apparatus body 2, as well as a sheet supplying mechanism 22 for transporting the sheet P from the sheet feeding tray 21 to the image forming section 30. The sheet supplying mechanism 22 is provided on a front side of the sheet supplying tray 21, and mainly includes a feed roller 23, a separation roller 24, and a separation pad 25.

In the sheet feeding section 20, the sheets P in the sheet feeding tray 21 are separated one by one and are sent upward, and paper dust is removed as the sheet P passes between a paper dust removal roller 26 and a pinch roller 27. The sheet P then passes along a transport path 28 to undergo a direction change toward the backward direction, and is supplied to the image forming section 30.

The image forming section 30 comprises four LED units 40, four process cartridges 50, a transfer unit 70, a cleaning section 10, and a fixing unit 80.

Each LED unit 40 is swingably connected to the LED mounting member 5, and is supported by being appropriately positioned by a positioning member provided in the apparatus body 2.

The process cartridges 50 are disposed between the upper cover 3 and the sheet feeding section 20 in such a manner as to be arranged in the front-back direction, and each comprise a photoconductor drum 53 on which an electrostatic latent image is formed, as well as a charger, a development roller, and a toner accommodating chamber, which are shown with reference numerals omitted and are known. A drum cleaner 54 is in contact with the photoconductor drum 53 and temporarily holds the toner remaining on the photoconductor drum 53 and returns it to the photoconductor drum 53 during a cleaning operation. A voltage is applied to the drum cleaner 54 by the controller 100 so as to electrically hold the toner and return the toner to the photoconductor drum 53.

The transfer unit 70 is provided between the sheet feeding section 20 and the process cartridges 50, and mainly includes a drive roller 71, a driven roller 72, a transport belt 73, and transfer rollers 74.

The drive roller 71 and the driven roller 72 are disposed in parallel in such a manner as to be spaced apart in the front-back direction, and the transport belt 73 comprises an endless belt stretched therebetween. An outer surface of the transport belt 73 is in contact with each photoconductor drum 53. Additionally, four transfer rollers 74, which nip the transport belt 73 between the transfer rollers 74 and the photoconductor drums 53, are disposed on the inner side of the transport belt 73 in face-to-face relation with the respective photoconductor drums 53. A transfer bias (first bias) is applied to each of these transfer rollers 74 by constant current control during the transfer.

The cleaning section 10 is provided on that portion of the transport belt 73, which is stretched on the lower side, and includes a waste toner case 11, as well as a cleaning roller 12, a backup roller 13, a second cleaning roller 14, and a blade 15.

The cleaning roller 12 is disposed adjacently to an outer peripheral surface of the transport belt 73.

The backup roller 13 is disposed opposite to the cleaning roller 12 with the transport belt 73 positioned between the backup roller 13 and the cleaning roller 12, and nips the transport belt 73 in cooperation with the cleaning roller 12.

The second cleaning roller 14 is disposed in the rear of the cleaning roller 12 and is contiguous therewith.

The blade 15 has its leading end in contact with the second cleaning roller 14, and is adapted to scrape off the toner attached to the second cleaning roller 14.

The waste toner case 11 is disposed below the cleaning roller 12 and the second cleaning roller 14, and is configured as to receive the toner scraped off by the blade 15.

A bias (second bias) for causing the toner on the transport belt 73 to move toward the cleaning roller 12 is applied between the backup roller 13 and the cleaning roller 12 by the controller 100. This second bias is changed, as required, in accordance with the operational mode such as during cleaning and printing. It should be noted the bias (second bias) applied to the cleaning roller will be hereafter referred to as the cleaning bias irrespective of the magnitude of its voltage.

The fixing unit 80 is disposed on the rear side of the process cartridges 50 and the transfer unit 70, and includes a heat roller 81 and a pressure roller 82, which are disposed in opposing relation to the heat roller 81 and are adapted to press the heat roller 81.

In the image forming section 30 thus configured, after the surface of each photoconductor drums 53 is first charged uniformly by the charger, the surface of each photoconductor drums 53 is exposed by each LED unit 40. Consequently, the potential at the exposed portion drops, and an electrostatic latent image is formed on each photoconductor drum 53 based on image data. Then, as toner is supplied to the electrostatic latent image by the development roller, a toner image is carried on the photoconductor drum 53.

Next, as the sheet P fed onto the transport belt 73 passes between each photoconductor drum 53 and each transfer roller 74 disposed on the inner side of the transport belt 73, the toner image formed on each photoconductor drum 53 is transferred onto the sheet P. Then, as the sheet P passes between the heat roller 81 and the pressure roller 82, the toner image transferred onto the sheet P is thermally fixed.

The sheet discharging section 90 includes a discharged sheet side transport path 91, which is formed in such a manner as to extend upward from an outlet of the fixing unit 80 and then to curve back toward the front side of the color printer, and a plurality of pairs of transport rollers 92 for transporting the sheet P. The sheet P onto which the toner image has been transferred and thermally fixed is transported along the discharged sheet side transport path 91 by the transport rollers 92, is discharged to the outside of the apparatus body 2, and is accumulated on the sheet discharging tray 4.

<Bias Control of Cleaning Section>

Next, a description will be given of control of the bias applied to the cleaning roller 12.

Figure 2:
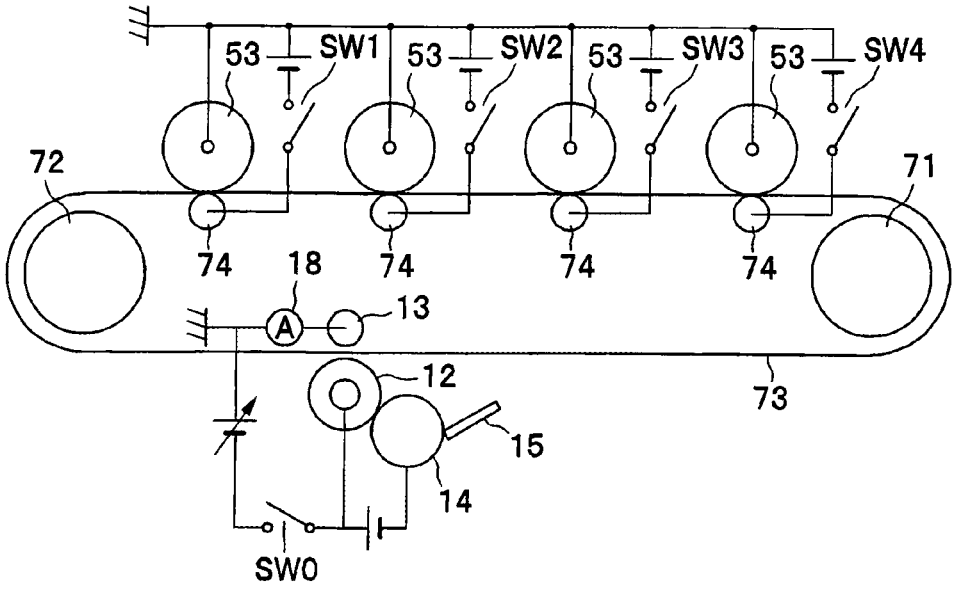
FIG. 2 is a circuit diagram for applying a voltage to each roller in the exemplary embodiment of the present invention.
Figure 3A:
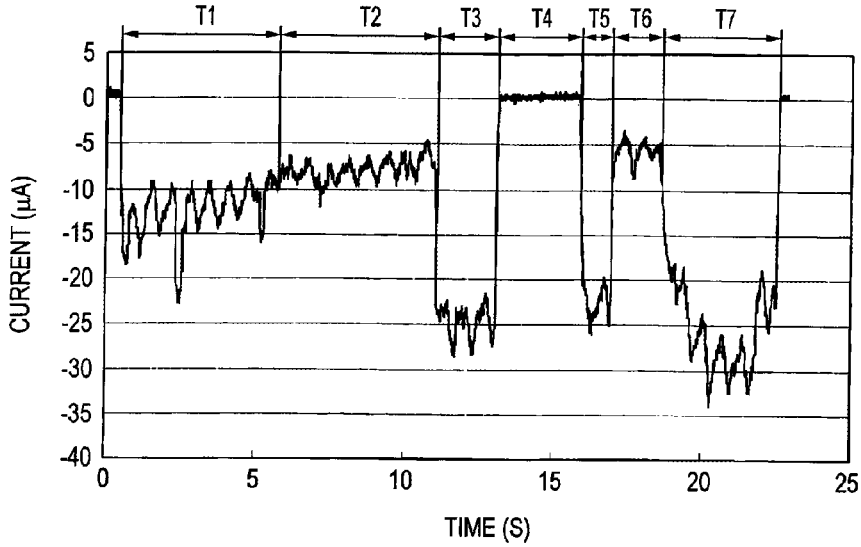
FIGS. 3A and 3B are graphs illustrating the change over time of a current flowing across a cleaning roller in the exemplary embodiment of the present invention.
Figure 3B:
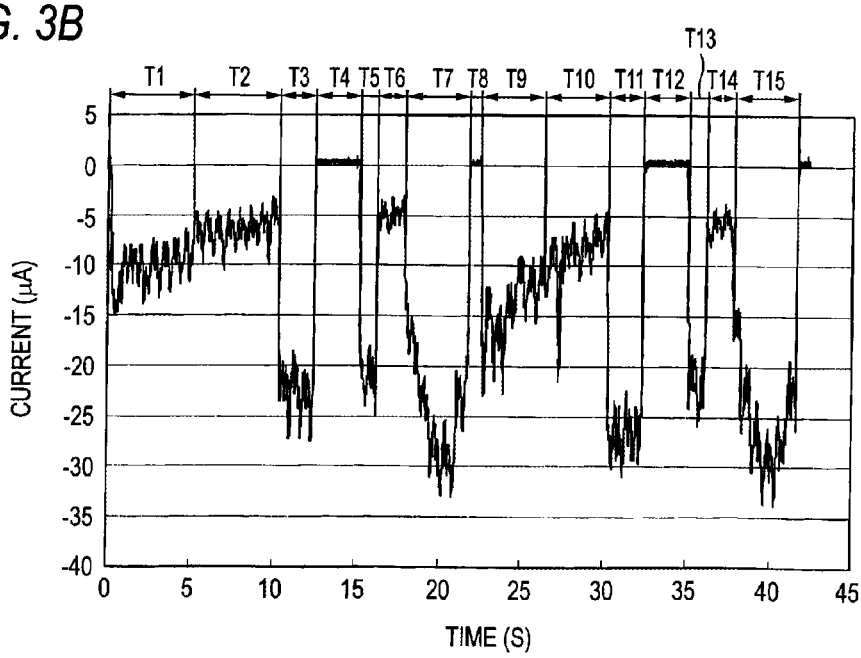

Among the drawings to which reference is made, FIG. 2 is a circuit diagram for applying a voltage to each roller, and FIGS. 3A and 3B are graphs illustrating the change over time of the current flowing across the cleaning roller. It should be noted that, in this embodiment, a description will be given by describing a positively chargeable toner as an example, but exemplary embodiments of the present invention are similarly applicable to the case of the toner having an opposite polarity. The polarity and magnitude of the transfer bias is appropriately set in correspondence with the charging polarity of the toner.

As shown in FIG. 2, a power supply, which applies a negative voltage to the cleaning roller 12, is connected to the cleaning roller 12, while the backup roller 13 is connected to the ground and is provided with an ammeter 18 to measure the electric current flowing across the backup roller 13. An embodiment of the ammeter 18 may directly measure the voltage. A switch SW0 is provided in a circuit that allows the current to flow between the backup roller 13 and the cleaning roller 12.

Meanwhile, the base material of each of the four photoconductor drums 53 is formed of aluminum, and the aluminum is connected to the ground. A power supply, which applies a negative voltage to the transfer roller 74, is connected to each of the transfer rollers 74, and switches SW1, SW2, SW3, and SW4 are respectively provided in circuits connecting each of the transfer rollers 74 and their respective power supplies.

With reference to FIGS. 3A and 3B, a description of the change of the measured current accompanying the movement of the transport belt 73 will be given hereinafter.

It should be noted that the time scales on FIG. 3A and 3B are different. A time period Tn corresponds between FIGS. 3A and 3B. It should also be noted that although the graphs of the time periods T1 to T7 in FIGS. 3A and 3B are not based on identical measured data, the graphs are based on data taken during equivalent operations of the printer, so that the time periods are herein denoted by the same reference numerals T1 to T7 for convenience' sake.

In the graphs of FIGS. 3A and 3B, the cleaning bias is not applied during the time periods T4, T8, and T12, so that the current is 0. During the time periods T1 to T3, T5 to T7, T9 to T11, and T13 to T15, a cleaning bias is applied at a fixed voltage. The measured current values during these periods varies due to the transport belt 73 being moved with time, resulting in different portions of the transport belt 73 being nipped by the cleaning roller 12 and the backup roller 13. As a result of the direction and magnitude of the applied electric field differing in the respective portions of the transport belt 73, the charged state for the respective portions also differed, and the difference in this charged state appeared as the difference in measured current values.

For example, the time periods T1 and T2 are periods when the transport belt 73 idled prior to the start of image formation after the starting of the printer. The time period T1 indicates a first revolution of the transport belt 73, and the time period T2 indicates a second revolution of the transport belt 73. Between the first revolution and the second revolution of the transport belt 73, charging with a same polarity gradually progressed, resulting in it gradually become difficult for the current to flow (current value became smaller). The time period T3 is a period when the portion of the transport belt 73 which was used in printing, i.e., the portion of the transport belt 73 to which a transfer bias was applied (hereafter, this portion will be simply referred to as the "portion"), was opposed to the cleaning roller 12. The time period T4 is a period when the transport belt 73 was temporarily stopped after printing, and a cleaning bias was not being applied. The time period T5 is a period when the portion to which the transfer bias was applied was being measured.

Further, the time period T6 is a period when the transfer bias was not being applied, and the time period T7 is a portion when the toner was discharged from the photoconductor drum 53 onto the transport belt 73. When the toner is discharged from the photoconductor drum 53 onto the transport belt 73, the toner is caused to move from the drum cleaner 54 onto the transport belt 73 through the photoconductor drum 53, so that the bias conditions are similar to those at the time of transfer.

As shown in FIG. 3B, during the time periods T9 to T15, operational modes similar to those of the time periods T1 to T7 are repeated. Namely, the time periods T9 to T15 correspond to the printing of a second sheet, and if a comparison is made with the first sheet, the measured current values are offset slightly.

Thus, the measured value of the current flowing across the cleaning roller 12 changes greatly in correspondence with the transfer bias and the cleaning bias applied to the transport belt 73, and if a comparison is made between the time of operation of the first sheet (first time) and the time of operation of the second sheet (second time), the measured current value changes slightly. Additionally, it can be understood that there are small fluctuations in the current value even during the same operational mode, e.g., even in the range of the time period T1, for example. Thus, even if there is a large difference in the measured current value, it does not follow that the state of the transport belt 73 changes during a short time period. Therefore, in order to allow the change of the state due to the aging and use of the belt to be reflected on the cleaning bias during cleaning, it is necessary to acquire a current value fixed in the time scale such as the one shown in FIG. 3A or 3B (a time span during which only a few sheets are printed).

For this reason, in this embodiment, the controller 100 controls the second bias (cleaning bias) on the basis of the value of the current measured when a predetermined measurement range of the transport belt 73 is in contact with the cleaning members (the cleaning roller 12 and the backup roller 13), the measurement range being set to a range in which the conditions under which the first bias (transfer bias) and the second bias are applied are identical.

For example, the range in which the conditions under which the first bias and the second bias are applied are identical may be a range in which both the first bias and the second bias are not applied. As another example, the range may be a range in which the first bias is applied a predetermined number of times, e.g., one time. As still another example, the range may be a range in which the first bias is not applied and the second bias is applied a predetermined number of times, e.g., one time.

Thus, since the current value is measured in the range in which the conditions under which the first bias and the second bias are applied are identical, the measurement range may be set to a range in which the transport belt 73 is disposed opposite to the cleaning members after a predetermined time duration has lapsed since the transport belt 73 was driven and the second bias was applied.

Additionally, the measurement range may be set to a range in which the transport belt 73 is disposed opposite to the cleaning members after a predetermined time duration has lapsed since the transport belt 73 was driven and the first bias was applied.

Furthermore, if the measurement range is considered by focusing attention on the position of the transport belt 73, the measurement range may be set to a predetermined range in which the position on the transport belt 73 is offset in a backward direction by a predetermined length of the transport belt 73, in the advancing direction, from a reference position on the transport belt 73 disposed opposite the cleaning members when the transport belt 73 is driven and the second bias is applied.

Still further, the measurement range may be set to a predetermined range offset in a backward direction by a predetermined length of the transport belt 73, in the advancing direction, from a reference position on the transport belt 73 disposed opposite the transfer roller 74 when the transport belt 73 is driven and the first bias is applied. Here, when there are a plurality of the transfer rollers 74, as in this embodiment, determining which one of the transfer rollers 74 to set as a reference can be problem. However, if the reference position is set to be a single one point, the reference may be any one of the transfer rollers 74. For example, the reference may be set to be the most downstream transfer roller 74. Additionally, since the transfer bias, which is applied to each transfer roller 74 during printing, is in the same range on the transport belt 73, as will be described later, any one (or all) of the plurality of transfer rollers 74 may be set as the reference as far as the time of printing is concerned.

The bias applied to the transport belt 73 is not limited to the first and second biases, and a third bias may be applied to the transport belt 73 by further providing a third bias application member. The measurement range may also be set in such a range that the conditions, under which the first bias, the second bias, and the third bias are applied, are identical.

Further, the third bias application member may, at this time be, for example, a roller is provided in the rear, in the advancing direction of the transport belt 73, of the transfer member, and which nips the sheet P in cooperation with the transport belt 73.

Additionally, to eliminate the effect of the aforementioned "fluctuations" of the measured current value in a short time period, the controller 100 may desirably be configured to control the second bias on the basis of a value obtained by averaging a plurality of current values measured in the measurement range.

Further, before the measuring of the current after the image formation has been started, the controller 100 may control the second bias on the basis of the value of the current previously detected by the ammeter 18. By so doing, it is possible to satisfactorily control the second bias even before the current has been measured.

Additionally, the belt may be an intermediate transfer belt onto an outer peripheral surface of which the toner is supplied from the plurality of photoconductor drums 53, as will be described later. Still further, the image forming apparatus may further comprise a secondary transfer roller for transferring an image from the intermediate transfer belt onto the sheet P, as a fourth bias is applied while the secondary transfer roller nips the sheet P in cooperation with the intermediate transfer belt, and the measurement range being set in a range in which the conditions, under which the first bias, the second bias, and the fourth bias are applied, are identical.

Referring now to the drawings, a detailed description will be given of the various specific embodiments of the second bias control in accordance with the above described features of the exemplary embodiment of the present invention.

<Embodiment 1: Measurement in a Range in which Biases Are Not Applied>

Figure 4:
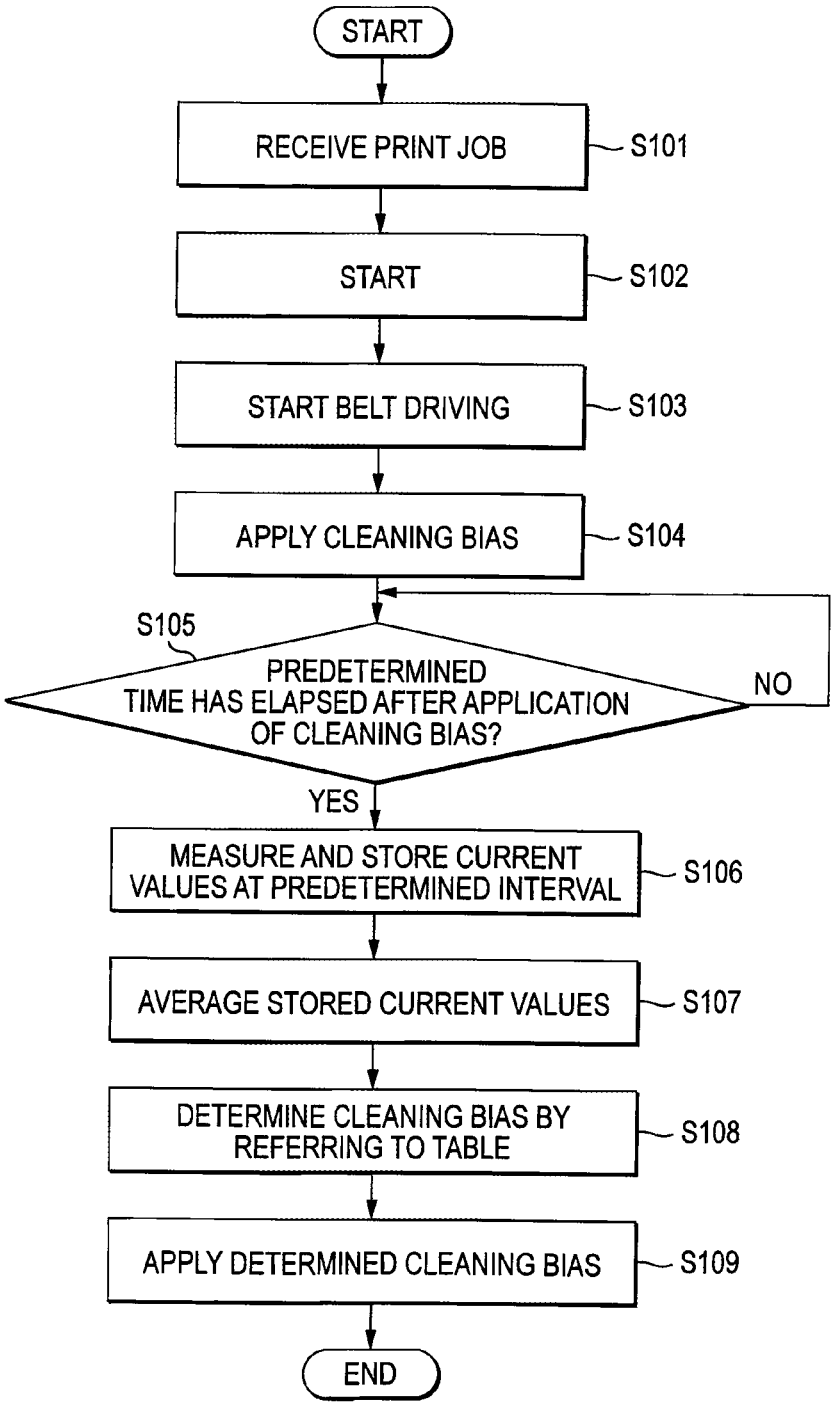
FIG. 4 is a flowchart explaining the control of a cleaning bias in the exemplary embodiment of the present invention.
Figure 5:
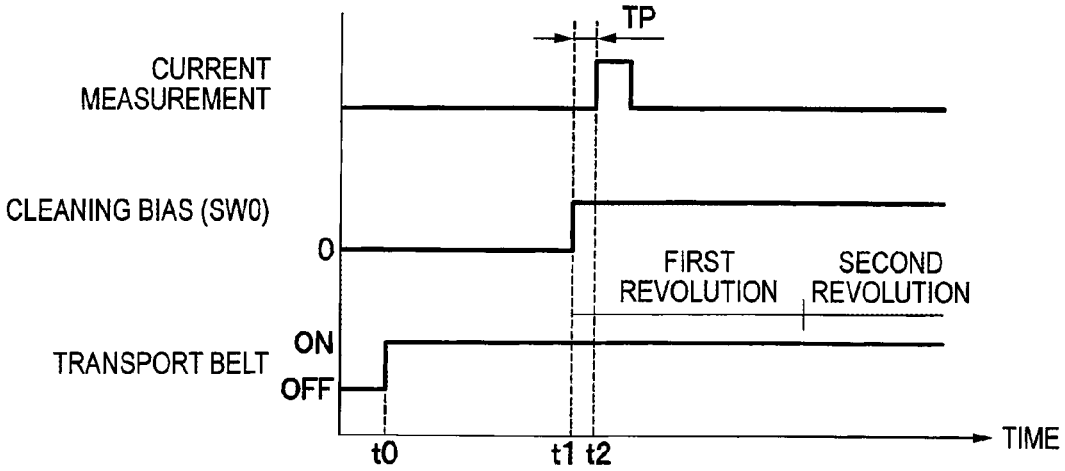
FIG. 5 is a graph illustrating the timings of the operation of a transport belt, application of the cleaning bias, and current measurement in a exemplary embodiment of the present invention.
Figure 6A:
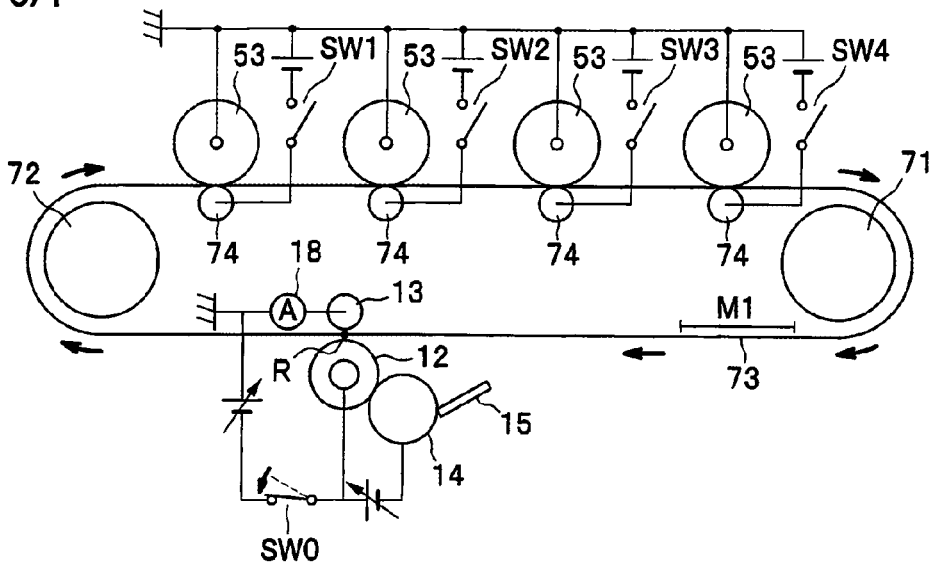
FIGS. 6A and 6B are diagrams explaining the charged state of the transport belt and a measurement range in the exemplary embodiment of the present invention.
Figure 6B:
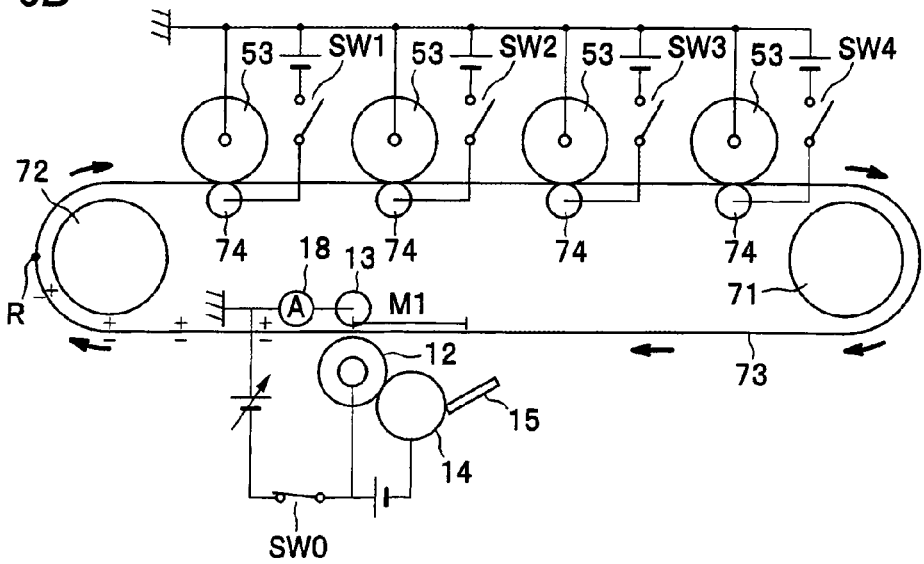

Among the drawings to which reference is made, FIG. 4 is a flowchart explaining the control of the cleaning bias. FIG. 5 is a graph illustrating the timings of the operation of the transport belt, application of the cleaning bias, and current measurement. FIGS. 6A and 6B are diagrams explaining the charged state of the transport belt and the measurement range.

When the measurement is made in the range in which the transfer bias and the cleaning bias are not applied, a case is assumed herein in which the color printer 1 has not been operated for some time, and the printing operation is initiated from the state in which the transport belt 73 is not electrically charged. It should be noted that various controls, such as arithmetic operations and storage are thereafter effected by the controller 100, though they are not described point by point.

Upon receiving a print job in a sleep state (S101), the color printer 1 initiates a predetermined starting operation (S102), and starts the driving of the transport belt 73 (S103). Then, as a cleaning bias is applied (S104), the toner and paper dust attached to the surface of the transport belt 73 are cleaned.

Then, a determination is made as to whether or not a predetermined time period TP has elapsed after the application of the cleaning bias (S105). After the predetermined time period has lapsed (S105: YES), the current value is measured a number of times at a predetermined interval by the ammeter 18, and the measured values are stored. For example, measurement is made 10 times at an interval of 10 msec, and the measured values of these 10 measurements are stored (S106). Furthermore, if the measurement is made 26 times at an interval of 50 ms, the measurement range becomes double the cycle of the cleaning roller, thereby making it possible to average the fluctuations in the cycle of the cleaning roller. In other words, if the current value is measured a plurality of times in a range corresponding to an integral multiple of the circumferential length of the cleaning roller, and these current values are averaged, it is possible to average the fluctuations corresponding to the cycle of the cleaning roller.

Next, the controller 100 averages the plurality of stored current values (S107) to obtain an average value. The average at this time may be a simple arithmetic average or a weighted average. Then, the cleaning bias is determined from the average value of the current values by making reference to a table (not shown) to convert a current value stored in advance to the cleaning bias (S108). The cleaning bias thus determined is applied to the cleaning roller 12 (S109).

The current flowing across the cleaning roller 12 is measured in the range disposed opposite to the cleaning roller 12 after the lapse of a predetermined time period, i.e., at a timing after the lapse of a predetermined time period from the point in time of application of the cleaning bias through the above-described processing. It should be noted that this timing must be set such that the range, in which the conditions of the biases applied to the transport belt 73 are identical, can be measured each time. Here, a description will be given of an example in which the measurement range is set to a range in which the biases are not applied. In the graphs shown in FIGS. 3A and 3B, the measurement in the range in which the biases are not applied corresponds to the measurement in the time period T1. Referring to FIG. 5, this is a period in which the transport belt 73 makes one revolution from the point of time (t1) when the cleaning bias (SW0) was applied, and the current is measured after the lapse of a predetermined time period TP at the timing t1 (there is a temporal width since the measurement is made a plurality of times).

With reference to FIGS. 6A and 6B, a description will be given of the charged state of the transport belt 73 in this measurement. As shown in FIG. 6A, when the transport belt 73 has started driving, SW0 is turned ON to apply the cleaning bias. At this time, the portion of the transport belt 73 which is nipped (faced) by the cleaning roller 12 and the backup roller 13 is set as a reference position R. A measurement range M1 is a range which is located rearwardly from the reference position R by a predetermined length in the moving direction of the transport belt 73.

As shown in FIG. 6B, after the lapse of several seconds from the application of the cleaning bias, the reference position R moves to a vicinity of the driven roller 72, so that the measurement range M1 also moves. At this time, the range between the reference position R of the transport belt 73 and the cleaning roller 12 is charged such that the inner side becomes positive due to the application of the cleaning bias. Further, the current is measured by the ammeter 18 from this point in time while the measurement range M1 is in contact with the cleaning roller 12. Then, at the timing in FIG. 6B (timing t2 in FIG. 5), the transport belt 73 has not made one revolution after application of the cleaning bias, and the transfer bias has not been applied, so that the measurement range M1 is a range in which neither the transfer bias nor the cleaning bias is being applied.

As the current is thus measured in the predetermined range in which neither the transfer bias nor the cleaning bias is being applied, the measured current values become stabilized. Additionally, since the current value is measured a plurality of times, and the cleaning bias is determined by using an averaged value, it is possible to improve the cleaning performance in cleaning the transport belt 73 by causing the states of the cleaning roller 12 and the transport belt 73 to be correctly reflected in the cleaning bias.

<Embodiment 2: Measurement in a Range in which Cleaning Bias is applied a Predetermined Number of Times>

Figure 7:
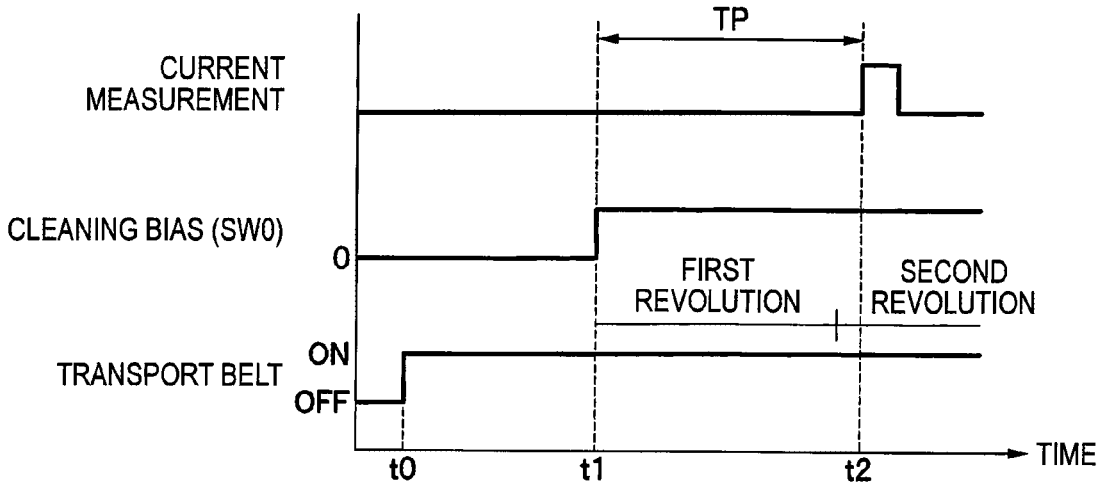
FIG. 7 is a graph illustrating the timings of the operation of the transport belt, application of the cleaning bias, and current measurement in another exemplary embodiment of the present invention.
Figure 8:
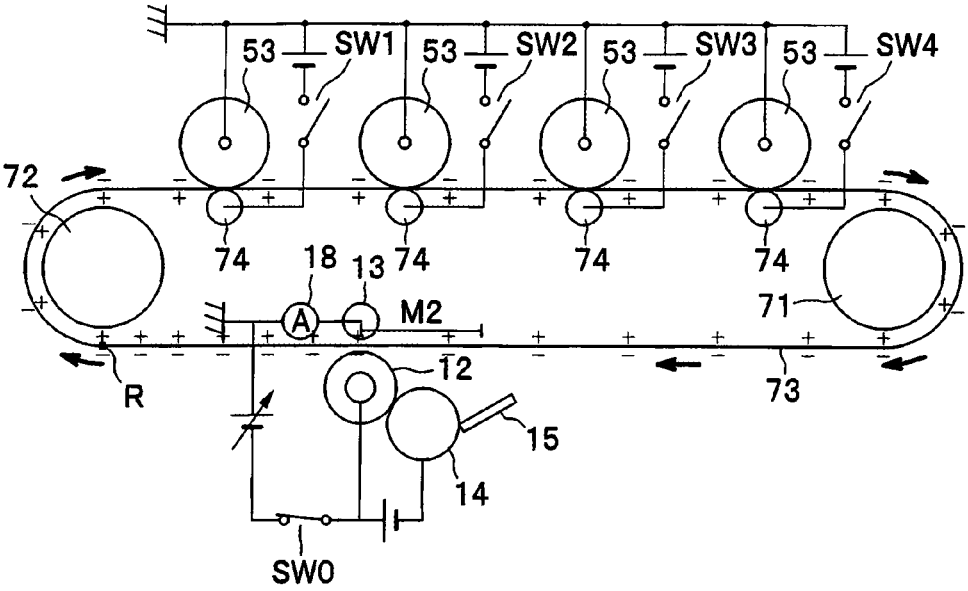
FIG. 8 is a diagram explaining the charged state of the transport belt and the measurement range in the exemplary embodiment of the present invention.

Among the drawings to which reference is made, FIG. 7 is a graph illustrating the timings of the operation of the transport belt, application of the cleaning bias, and current measurement. FIG. 8 is a diagram explaining the charged state of the transport belt and the measurement range.

In this case, the current value is measured in the range in which the cleaning bias is applied a predetermined number of times, and like the above-described measurement in a range in which the biases are not applied, the measurement range is set to a range of the transport belt 73 disposed opposite the cleaning roller 12 when a predetermined time period has elapsed since the application of the cleaning bias, as shown in FIG. 4. However, the timing of the measurement is set to a predetermined timing when the transport belt 73 has made one revolution or more after the start of application of the cleaning bias, as shown in FIGS. 7 and 8. As shown in FIG. 8, the range of the transport belt 73, which has been charged by the application of the cleaning bias one time, is disposed opposite the cleaning roller 12 at the reference position R, i.e., at a point in time when the position on the transport belt 73 where the cleaning bias was started to be applied has entered a second revolution after having undergone one revolution. Accordingly, as the current value is measured by the ammeter 18 when a measurement range M2, disposed to the rear from the reference position R by a predetermined length, is disposed opposite the cleaning roller 12, it is possible to measure the current in a predetermined range under conditions in which the cleaning bias has been applied one time and the transfer bias has not been applied a single time. For this reason, the measured current values become stabilized, and changes of the cleaning roller 12 and the transport belt 73 due to the environment, aging, or use can be correctly reflected on the cleaning bias, thereby making it possible to improve the cleaning performance in cleaning the transport belt 73.

<Embodiment 3: Measurement in a Range in which Transfer Bias is Applied a Predetermined Number of Times>

Next, a description will be given of a case in which the current is measured in a range in which the transfer bias is applied a predetermined number of times.

Figure 9:
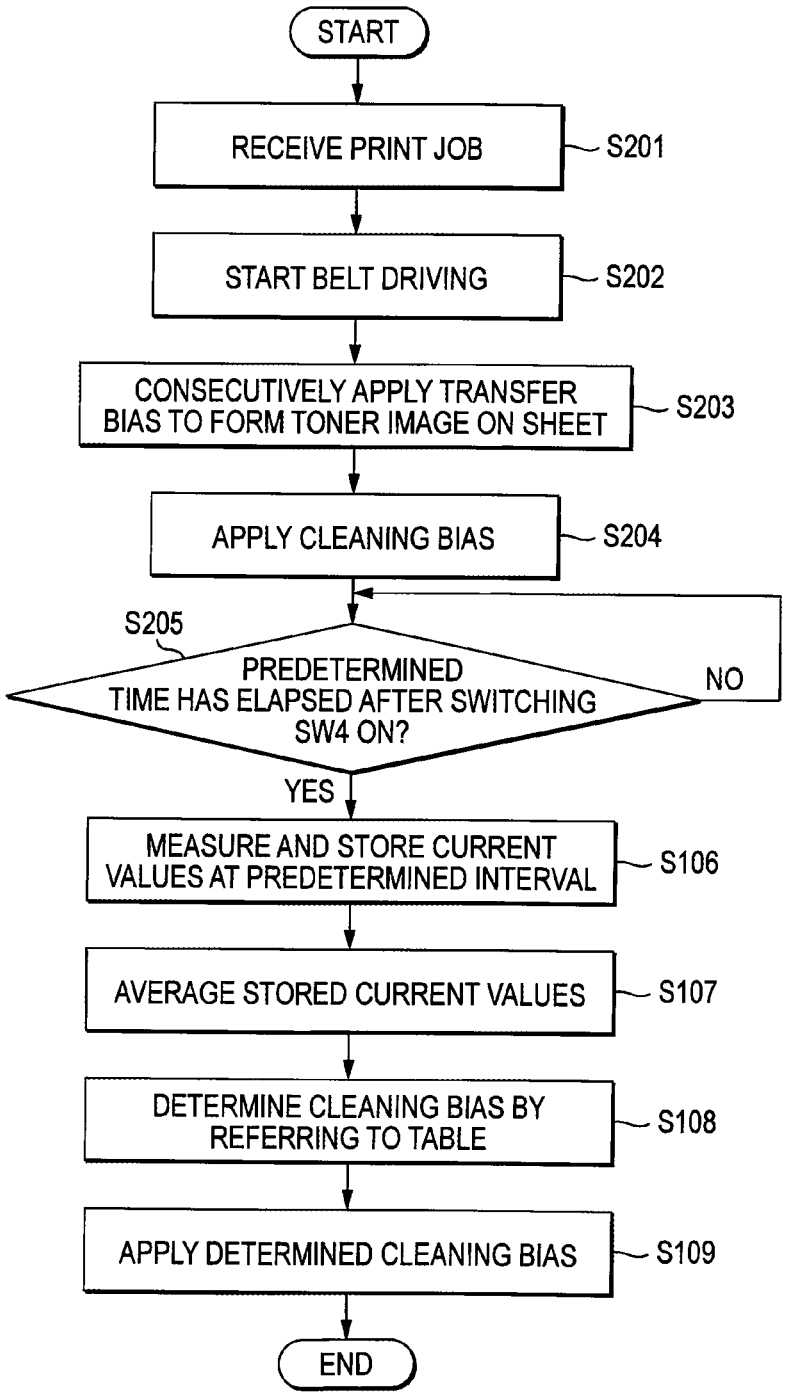
FIG. 9 is a flowchart explaining the control of the cleaning bias in another exemplary embodiment of the present invention.
Figure 10:
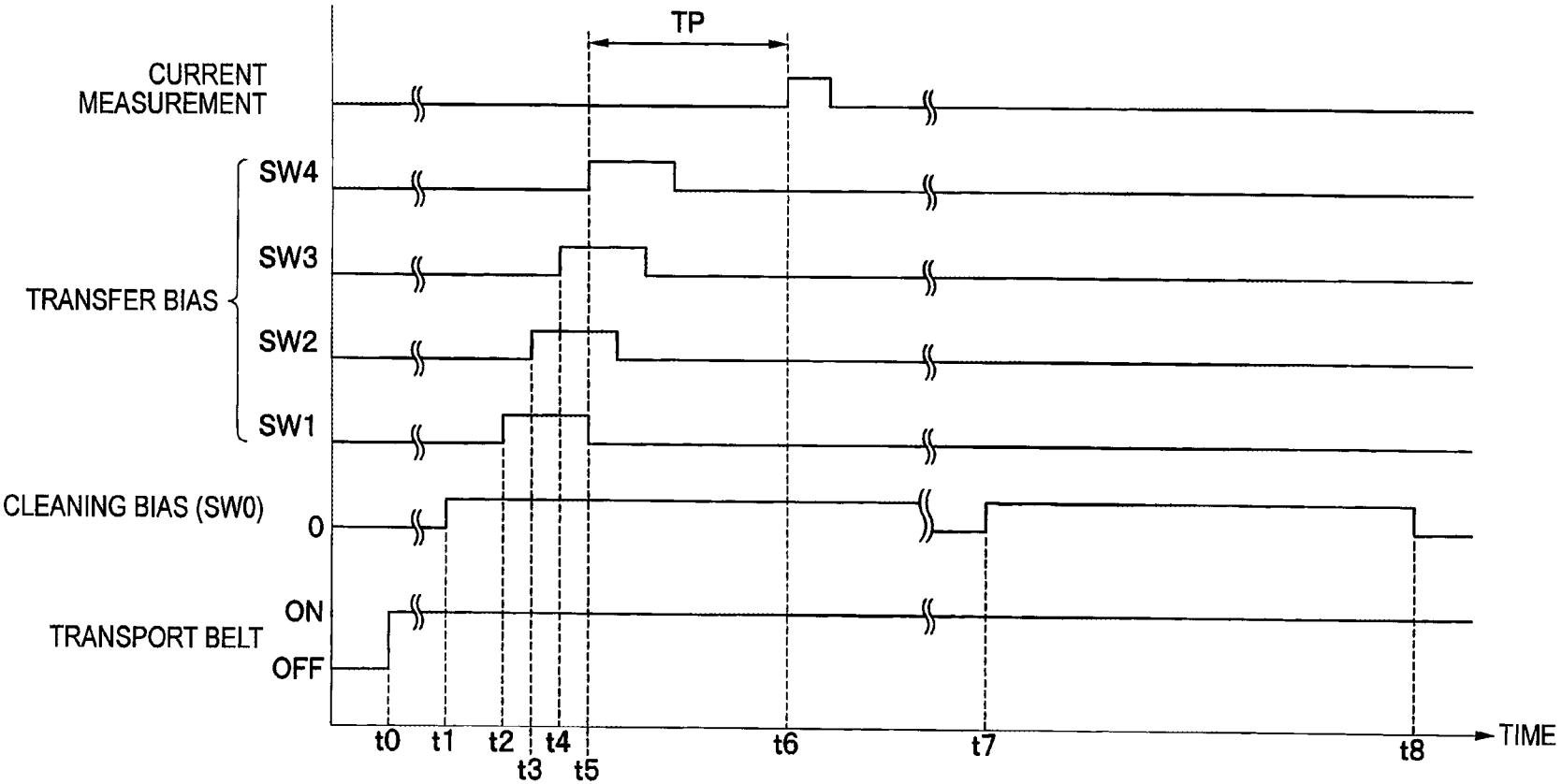
FIG. 10 is a graph illustrating the timings of the operation of the transport belt, application of the cleaning bias, and current measurement in the exemplary embodiment of the present invention.

Among the drawings to which reference is made, FIG. 9 is a flowchart explaining the control of the cleaning bias. FIG. 10 is a graph illustrating the timings of the operation of the transport belt, application of the cleaning bias, and current measurement. FIGS. 11A to 13B are diagrams explaining the charged state of the transport belt and the measurement range.

In this form, upon receiving a print job (S201), the color printer 1 starts driving of the transport belt 73 (S202). A transfer bias is consecutively applied to each transfer roller 74 corresponding to the photoconductor drum 53 corresponding to each color to form a toner image on the sheet P. Upon completion of the transfer onto the sheet P, a cleaning bias is applied to the cleaning roller 12 to effect the cleaning of the transport belt 73. A determination is then made as to whether or not the predetermined time period TP has elapsed after the switch SW4 has been turned ON for transfer, i.e., after the switch SW4 has been turned ON to apply a bias to the transfer roller 74 most downstream in the moving direction of the transport belt 73 (here, the moving direction along the four juxtaposed transfer rollers 74) among the four transfer rollers 74 (S205).

After the lapse of the predetermined time period TP (S205: YES), the current value is measured a number of times at a predetermined interval by the ammeter 18, and the measured values are stored (S106). Next, the controller 100 averages the plurality of stored current values (S107) to obtain an average value. Then the cleaning bias is determined from the average value of the current values by making reference to a table (not shown) to convert from a current value stored in advance to the cleaning bias (S108). The cleaning bias thus determined is applied to the cleaning roller 12 (S109).

The current flowing across the cleaning roller 12 is measured in the range disposed opposite the cleaning roller 12 after the lapse of a predetermined time period, i.e., at a time after the lapse of a predetermined time period from the point in time of the application of the transfer bias to the most downstream transfer roller 74 through the above-described processing. It should be noted that this timing must be set such that the range, in which the conditions of the biases applied to the transport belt 73 are identical, can be measured each time. To facilitate understanding, a description will be given here of an example in which the measurement range is set to a range in which the durations of the time periods T1 and T2 are shortened in the graphs of FIGS. 3A and 3B, the transfer bias is applied four times, and the cleaning bias is applied one time.

As shown in FIG. 10, after the driving of the transport belt 73 has started (ON) (t0), the cleaning bias (SW0) is applied, and the switches SW1 to SW4 are consecutively turned ON (t2 to t5), thereby transferring a toner image from each photoconductor drum 53 onto the sheet P. Then, the current value is measured by the ammeter 18 after the lapse of the predetermined time period TP from the time (t5) at which the application of the finally applied transfer bias was started. It should be noted that although the timings when the respective switches SW1 to SW4 are ON are offset from each other, the respective switches SW1 to SW4 are changed between ON and OFF at the same position on the transport belt 73 and the sheet P because the transport belt 73 and the sheet P are moving.

Figure 11A:
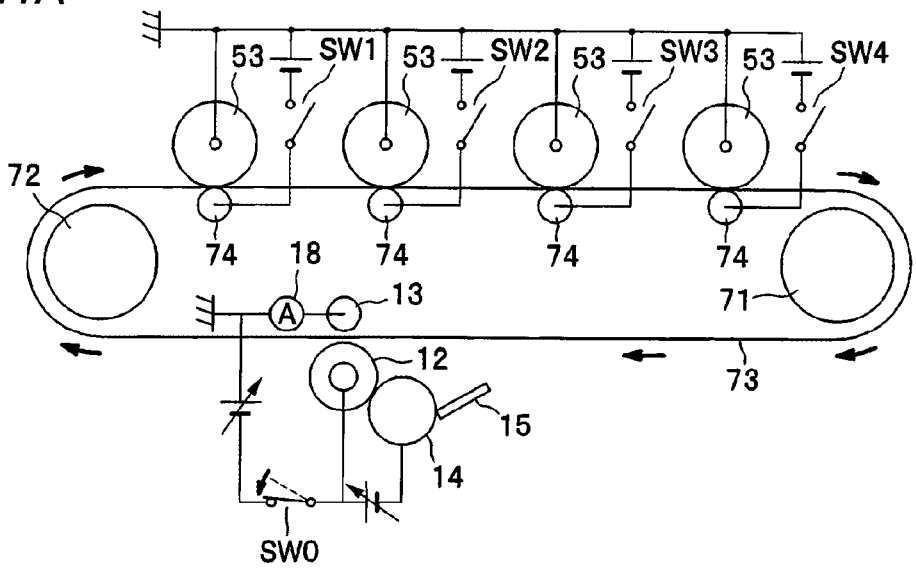
FIGS. 11A and 11B are diagrams explaining the charged state of the transport belt and the measurement range in the exemplary embodiment of the present invention.
Figure 11B:
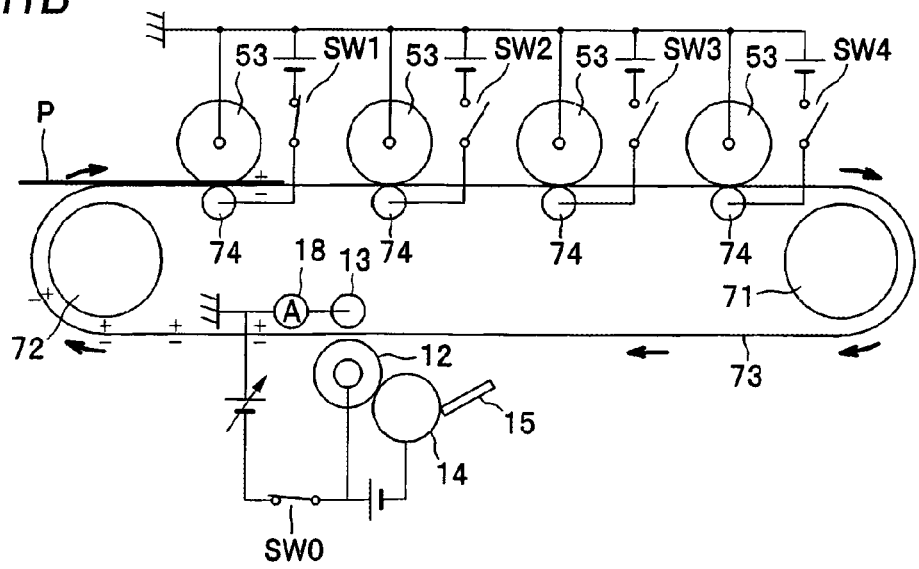

The charged state of the transport belt 73 during this measurement will be described with reference to FIGS. 11A to 13B. As shown in FIG. 11A, after the driving of the transport belt 73 has started, the switch SW0 is turned ON to apply the cleaning bias. Then, as shown in FIG. 11B, the switch SW1 is turned ON when the sheet P enters a nip between the most upstream position of photoconductor drum 53 and the transfer roller 74.

Figure 12:
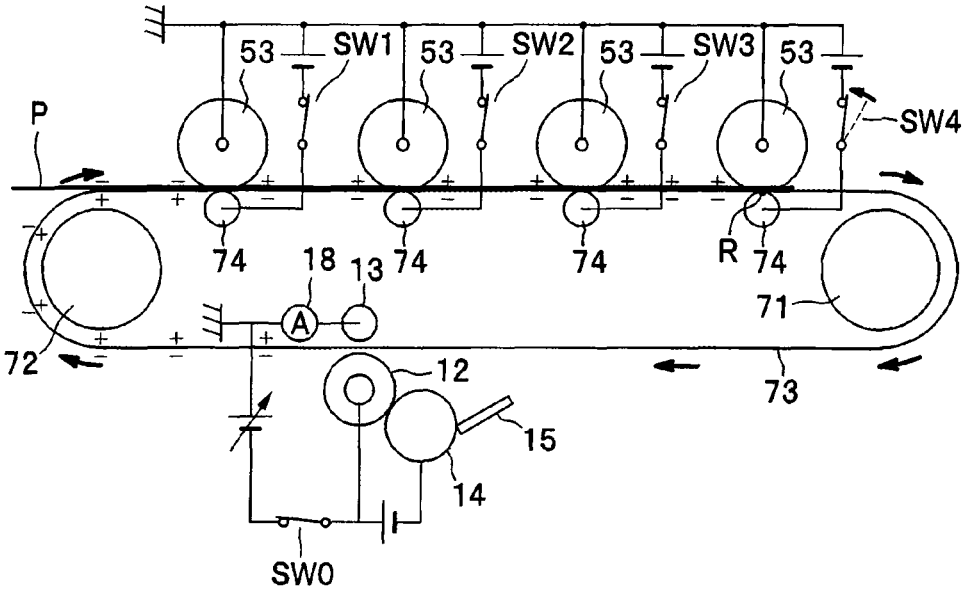
FIGS. 12 is a diagram explaining the charged state of the transport belt and the measurement range in the exemplary embodiment of the present invention.

As shown in FIG. 12, when the sheet P is transported by the transport belt 73, the switches SW1 to SW4 are consecutively turned ON to thereby apply a transfer bias to each transfer roller 74. The portion of the transport belt 73 disposed opposite the transfer roller 74, when the SW4 is turned ON, is set as the reference position R. The surface of the transport belt 73 is gradually charged such that the outer side becomes positively higher due to this transfer bias.

Figure 13A:
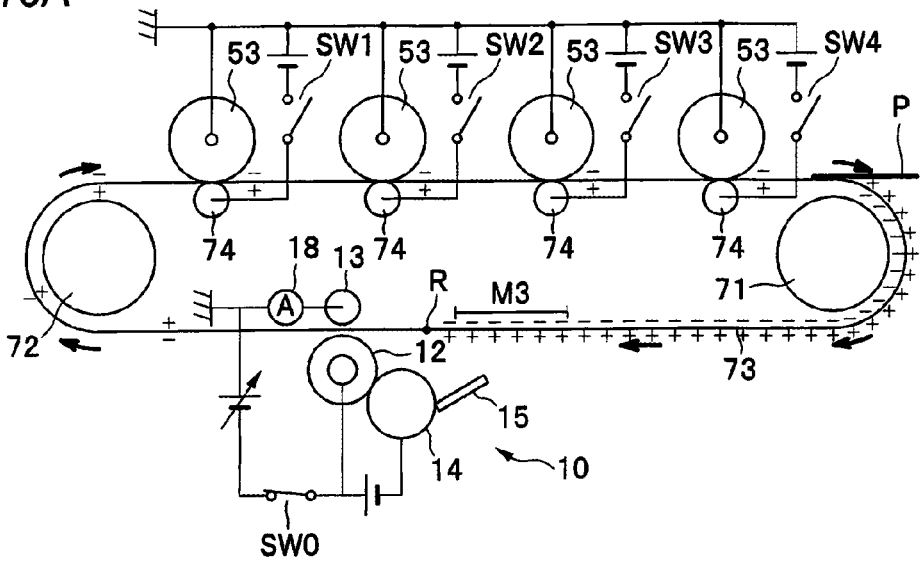
FIGS. 13A and 13B are diagrams explaining the charged state of the transport belt and the measurement range in the exemplary embodiment of the present invention.
Figure 13B:
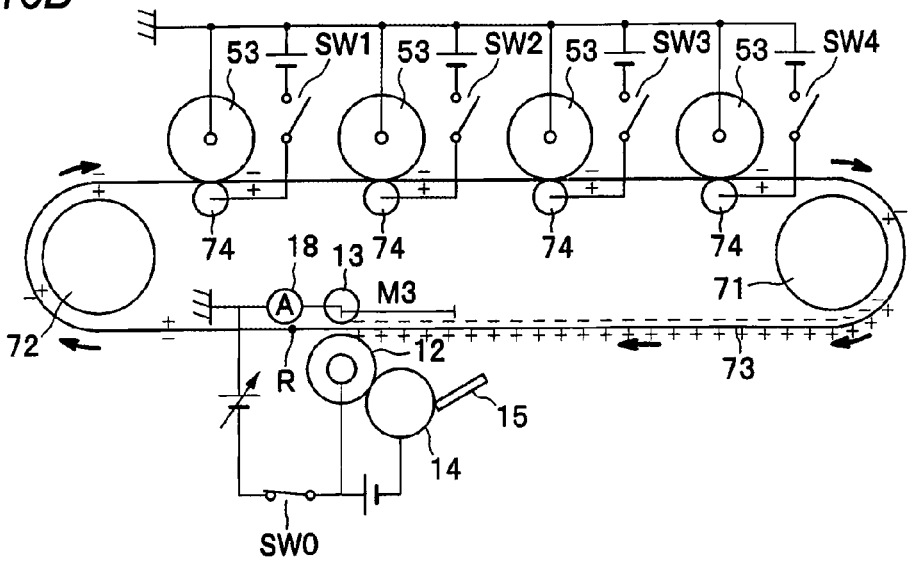

As shown in FIG. 13A, when the transfer of the toner onto the sheet P is completed, the portion of the transport belt 73, whose outer side became positive due to the application of the transfer bias, moves toward the cleaning section 10. When the reference position R has passed the cleaning roller 12, the current is measured by the ammeter 18, as shown in FIG. 13B. Here, the range of the transport belt 73 disposed, by a predetermined length in the advancing direction of the transport belt 73, toward the rear of the reference position R is a measurement range M3. As can be seen from FIGS. 13A and 13B, the measurement range M3 is the range in which the cleaning bias has been applied one time, and the transfer bias has been applied four times. It should be noted that the number of times the cleaning bias is applied increases in correspondence with the number times the transfer belt 73 has been idling.

As the current is measured in the predetermined range in which the transfer bias and the cleaning bias have been applied a predetermined numbers of times, the measured current values become stabilized. In addition, since the current value is measured a plurality of times, and the cleaning bias is determined by using an averaged value, it is possible to improve the cleaning performance in cleaning the transport belt 73 by causing the surface state of the transport belt 73 to be correctly reflected in the cleaning bias.

It should be noted that in the case where the cleaning bias is applied again at timings t7 and t8 in FIG. 10, the cleaning bias may be determined by using a current value measured and previously stored previously. As a result, even in a case where there has been no timing for measuring the current value for some time in view of the operational mode, it is possible to determine an optimum cleaning bias as practically as possible.

<Form 4: Measurement in a Range in Which Attraction Bias (Third Bias) is Applied>

Next, a description will be given of a case in which the current is measured in a range in which an attraction bias is applied.

Figure 14:
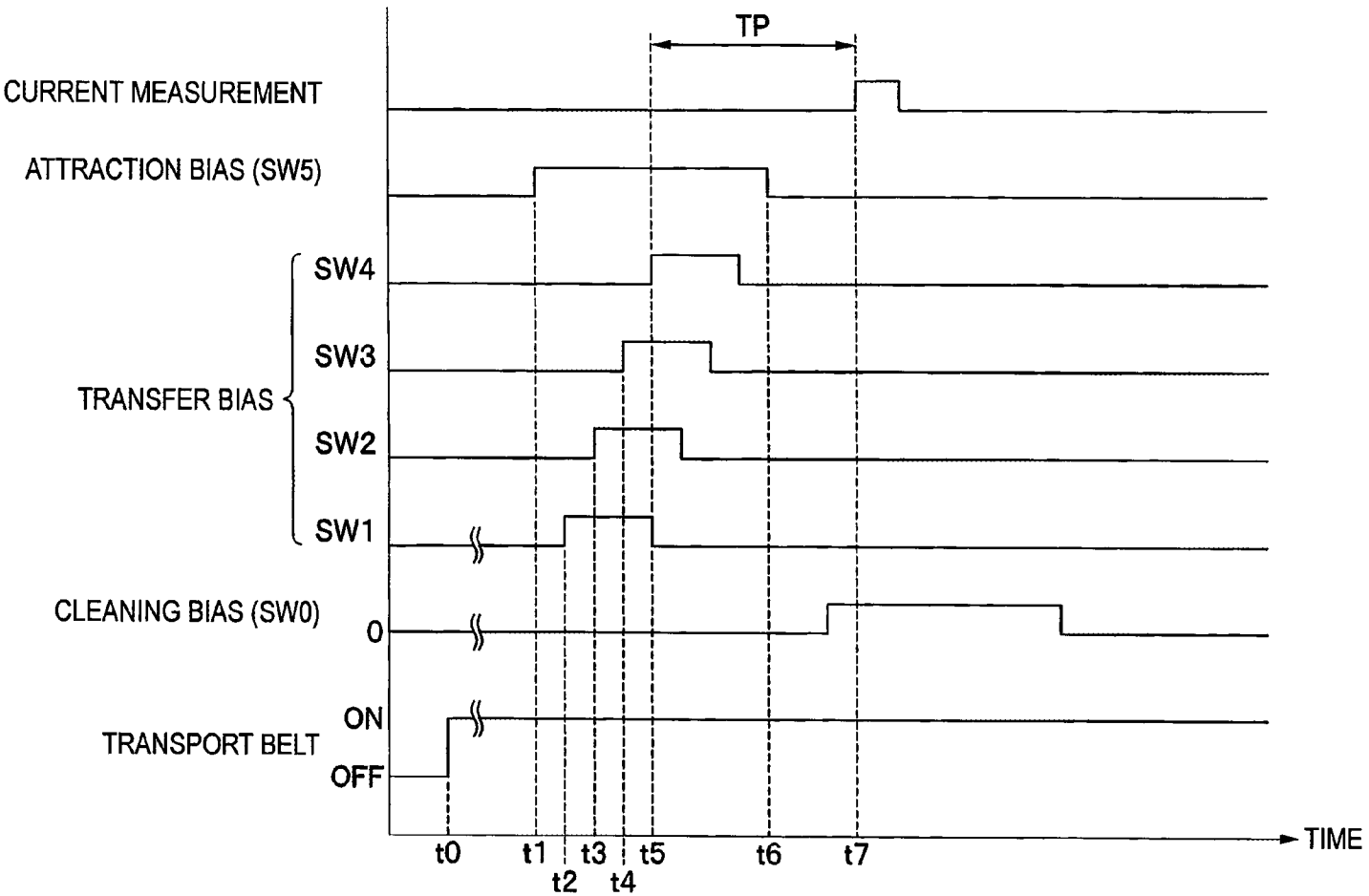
FIG. 14 is a graph illustrating the timings of the operation of the transport belt, application of the cleaning bias, transfer bias, and attraction bias, and current measurement in another exemplary embodiment of the present invention.
Figure 15A:
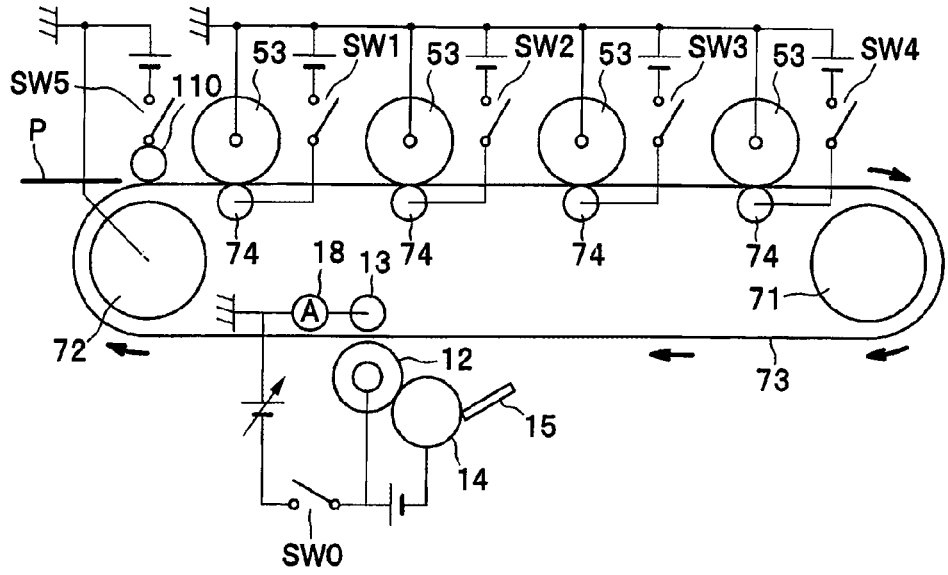
FIGS. 15A and 15B are diagrams explaining the charged state of the transport belt and the measurement range in the exemplary embodiment of the present invention.

Among the drawings to which reference is made, FIG. 14 is a graph illustrating the timings of the operation of the transport belt, application of the cleaning bias, transfer bias, and attraction bias, and current measurement. FIGS. 15A to 16 are diagrams explaining the charged state of the transport belt and the measurement range.

As shown in FIG. 15A, the color printer according to this embodiment is similar to the above-described color printer 1 except that an attraction roller 110 is provided as an example of a third bias application member to which a voltage is applied to attract the sheet P to an upper portion of the driven roller 72, and a switch SW5 for the application of this voltage is thus provided.

As shown in FIG. 14, since the attraction bias is for attracting the sheet P, the attraction bias is applied at timings t1 to t6 at which the sheet P opposes the transport belt 73.

Figure 15B:
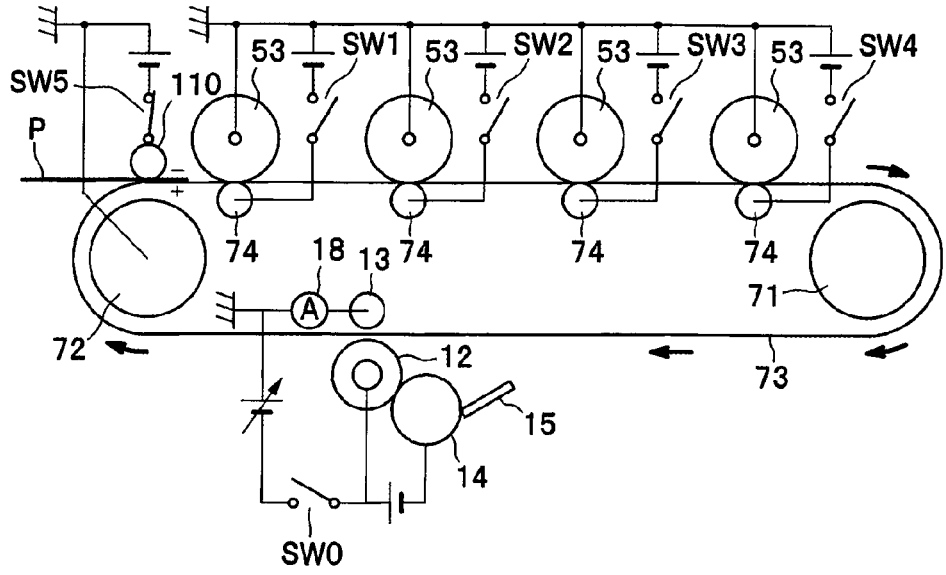
Figure 16:
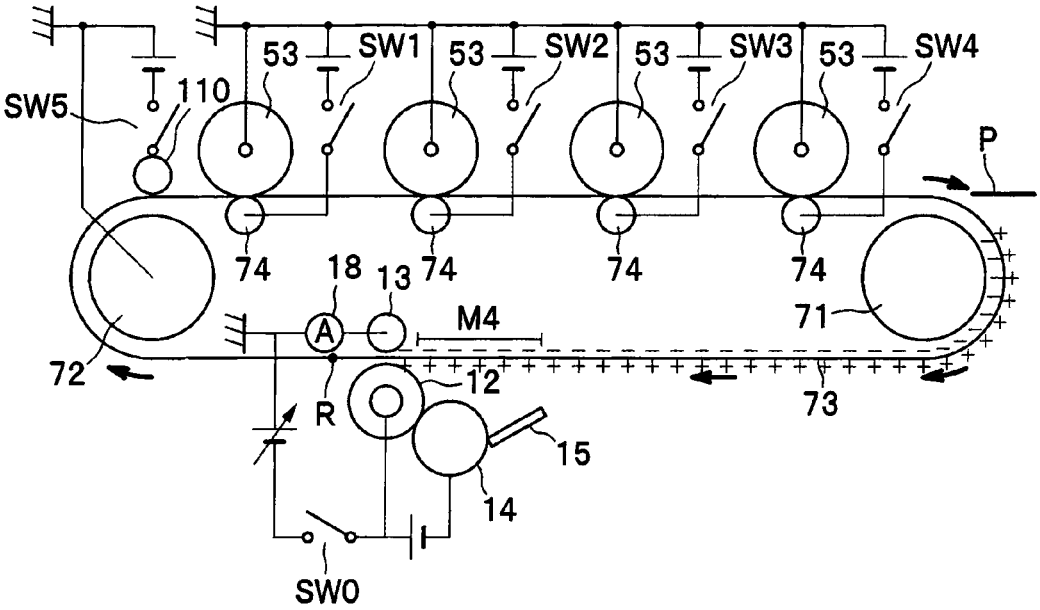
FIG. 16 is a diagram explaining the charged state of the transport belt and the measurement range in another exemplary embodiment of the present invention.

Further, as shown in FIGS. 15A and 15B, as the sheet P approaches the transport belt 73, the switch SW5 is turned ON to apply an attraction bias (t1). The attraction bias is applied so that the outer side of the transport belt 73 becomes negative. The transfer of the toner image onto the sheet P is effected in the same way as in Embodiment 3, and the transport belt 73 is disposed opposite the cleaning roller 12 in a state in which its outer side is positively charged, as shown in FIG. 16. Then, by using as the reference position R (see FIG. 12) the position on the transport belt 73 disposed opposite the most downstream transfer roller 74 when the transfer bias is started to be applied to that transfer roller 74 disposed on the most downstream side in the advancing direction, a measurement range M4 is disposed in the rear, in the advancing direction of the transport belt 73, from the reference position by a predetermined length in the same way as in the form 3. After the lapse of the predetermined time period TP (t7) from the time the switch SW4 was turned ON (t5), the controller 100 measures the value of the current flowing across the cleaning roller 12 with the ammeter 18. As a result, it is possible to measure the current value when the measurement range M4 is disposed opposite to the cleaning roller 12.

As can be understood from FIGS. 15A to 16, the measurement range M4 is a range in which the cleaning bias is applied one time, the attraction bias is applied one time, and the transfer bias is applied four times.

As the current is measured in the predetermined range in which the attraction bias, the transfer bias, and the cleaning bias have each been applied a predetermined numbers of times, the measured current values become stabilized. For this reason, it is possible to improve the cleaning performance in cleaning the transport belt 73 by causing the states of the cleaning roller 12 and the transport belt 73 to be correctly reflected in the cleaning bias.

<Embodiment 5: Measurement in a Range in Which Secondary Transfer Bias (Fourth Bias) is Applied>

Next, a description will be given of a case in which the toner image is not transferred onto the sheet on the transport belt, but the toner image is transferred onto the sheet through an intermediate transfer belt.

Figure 17:
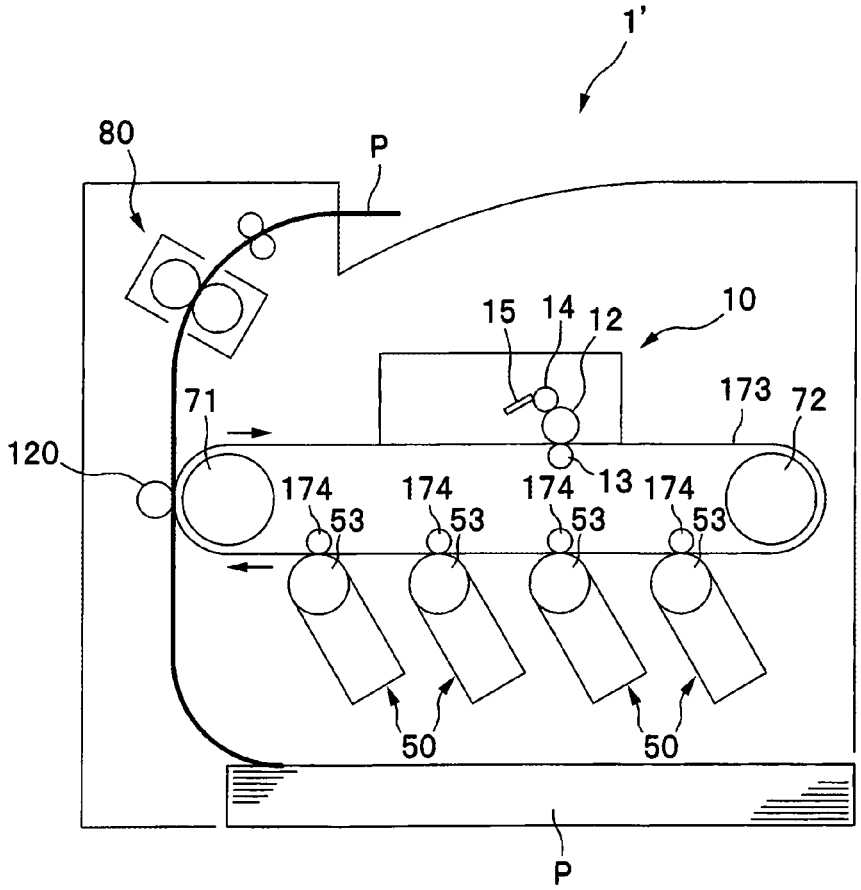
FIG. 17 is a schematic diagram of a printer having a secondary transfer roller in the exemplary embodiment of the present invention.
Figure 18:
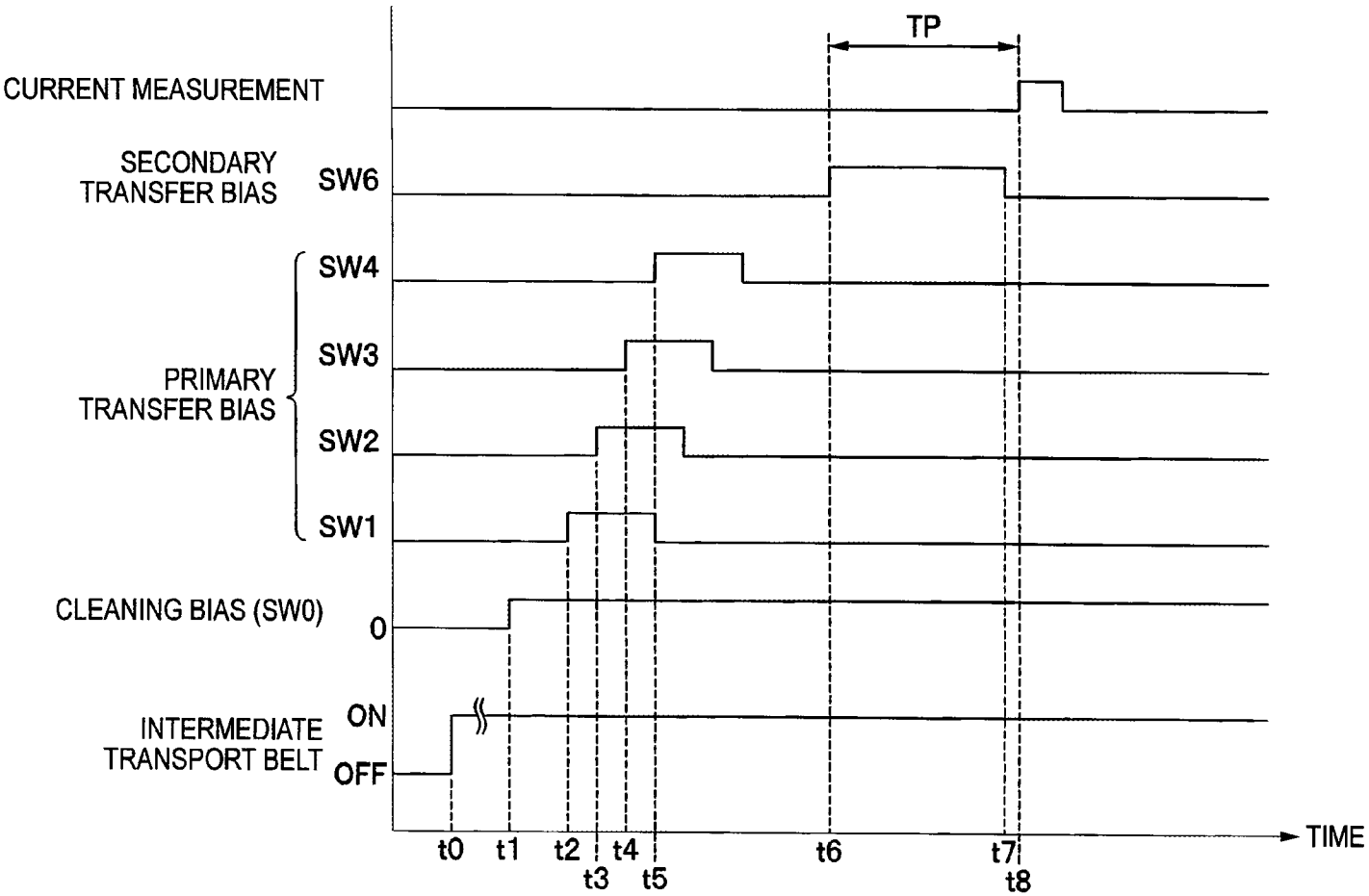
FIG. 18 is a graph illustrating the timings of the operation of the transport belt, application of the cleaning bias, primary transfer bias, and secondary transfer bias, and current measurement in the exemplary embodiment of the present invention.
Figure 19A:
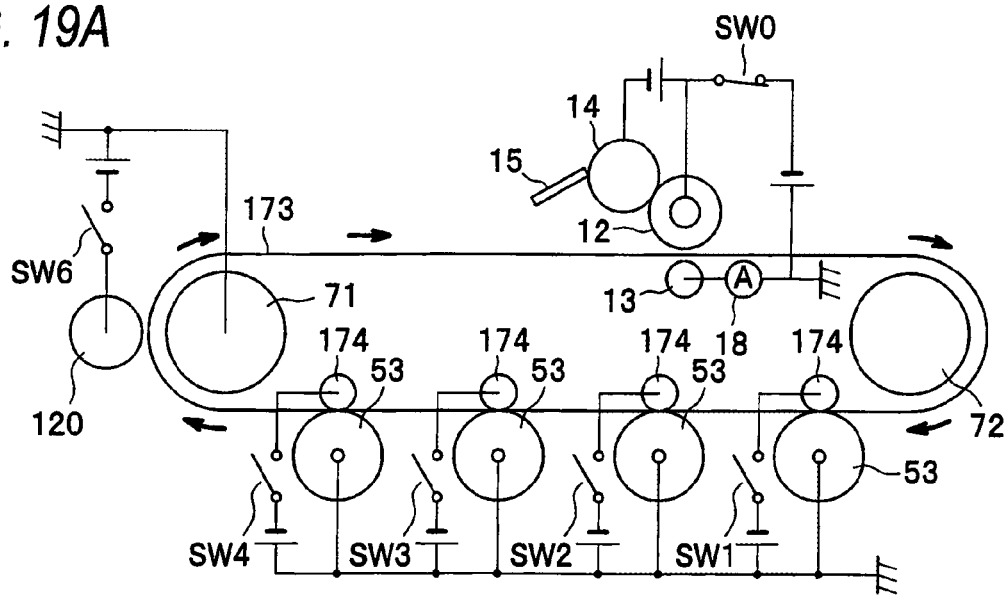
FIGS. 19A and 19B are diagrams explaining the charged state of an intermediate transfer belt and the measurement range in the exemplary embodiment of the present invention.
Figure 19B:
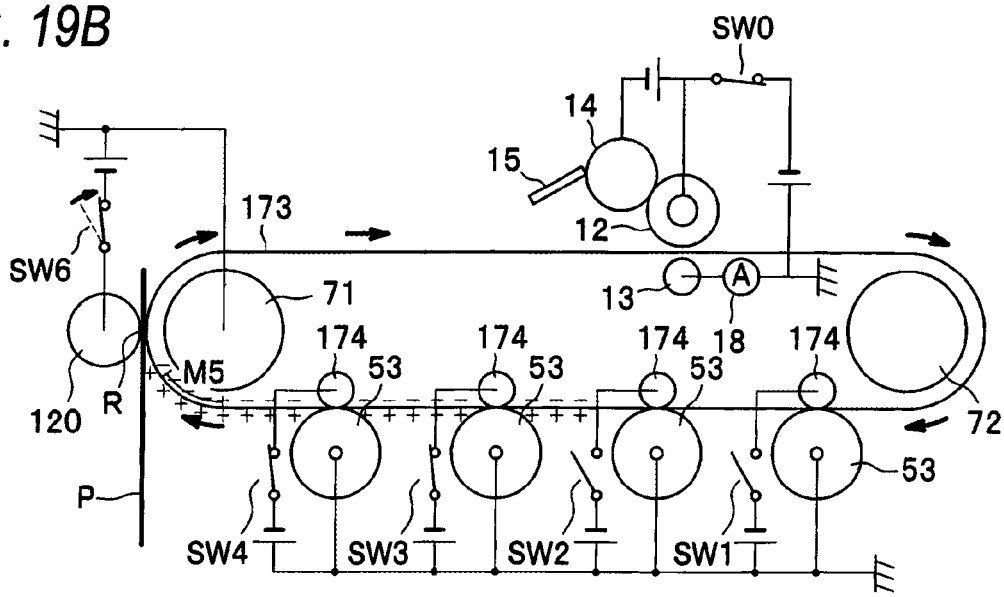
Figure 20:
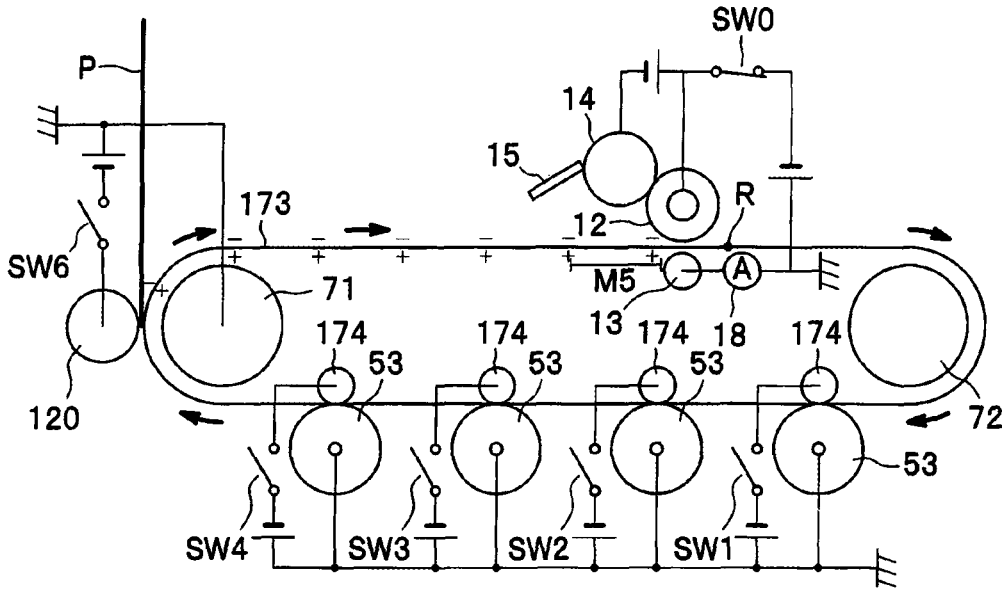
FIG. 20 is a diagram explaining the charged state of the intermediate transfer belt and the measurement range in the exemplary embodiment of the present invention.

Among the drawings to which reference is made, FIG. 17 is a schematic diagram of a printer having a secondary transfer roller. FIG. 18 is a graph illustrating the timings of the operation of the transport belt, application of the cleaning bias, primary transfer bias, and secondary transfer bias, and current measurement. FIGS. 19A to 20 are diagrams explaining the charged state of the intermediate transfer belt and the measurement range.

The color printer 1 shown in FIG. 17 is provided with an intermediate transfer belt 173, instead of the transfer belt 73, and a secondary transfer roller 120 is disposed in a face-to-face relation with the drive roller 71. In the light of the layout, the process cartridges 50 are provided below the intermediate transfer belt 173, and the cleaning section 10 is provided above the intermediate transfer belt 173. Primary transfer rollers 174, similar to the transfer rollers 74, are disposed in correspondence with the respective photoconductor drums 53.

As shown in FIG. 18, the controller 100 applies a primary transfer bias to each of the primary transfer rollers (t2 to t5) in the same way as the transfer bias was applied in embodiments 3 and 4 discussed above. As a result, a color toner image consisting of four color toners is formed on the intermediate transfer belt 173. Then, at a predetermined timing (t6 to t7) when the sheet P opposes the intermediate transfer belt 173, a secondary transfer bias is applied to the secondary transfer roller 120 to transfer the toner image onto the sheet P. The controller 100 measures the current value with the ammeter 18, after the lapse of the predetermined time period TP since the time the secondary transfer bias started to be applied (t6).

The charged state of the intermediate transfer belt 173 during this measurement will now be described with reference to FIGS. 19A to 20. As shown in FIG. 19A, after the intermediate transfer belt 173 has started driving, the switch SW0 is turned ON to apply the cleaning bias. Then, as shown in FIG. 19B, a primary transfer bias is consecutively applied to the primary transfer rollers 174 at appropriate timings. As a result, a toner image is formed on the intermediate transfer belt 173, and its outer side is positively charged. When this toner image approaches the secondary transfer roller 120, the sheet P is fed, and while the sheet P is nipped between the drive roller 71 and the secondary transfer roller 120, the switch SW6 is turned ON to apply a secondary transfer bias (fourth bias) to the secondary transfer roller 120 (t6 and t7), thereby transferring the toner image onto the sheet P. Then, upon completion of the transfer, the inner side of the intermediate transfer belt 173 is positively charged by the secondary transfer bias. If the position on the intermediate transfer belt 173 disposed opposite the secondary transfer roller 120 when the secondary transfer bias is started to be applied (t6) is set as the reference position R, the range of the intermediate transfer belt 173 located in the rear from the reference position by a predetermined length in the advancing direction of the intermediate transfer belt 173 becomes a measurement range M5. The current value is measured by the ammeter 18 when this measurement range M5 disposed opposite to the cleaning roller 12. As can be understood from FIGS. 19A to 20, the measurement range M5 is a range in which the cleaning bias is applied one time, the primary transfer bias is applied four times, and the secondary transfer bias is applied one time.

As the current is thus measured in the predetermined range in which the cleaning bias, the primary transfer bias, and the secondary transfer bias have been applied a predetermined numbers of times, the measured current values become stabilized. For this reason, it is possible to improve the cleaning performance in cleaning the intermediate transfer belt 173 by causing the states of the cleaning roller 12 and the intermediate transfer belt 173 to be correctly reflected in the cleaning bias.

As has been described in the above-described forms, according to the respective embodiments of the invention, since the current is measured in the range of the belt under the same conditions under which the bias was applied to the belt, the measured current values become stabilized. Hence, it is possible to improve the cleaning performance in cleaning the belt by causing the surface state, such as the deterioration and fouling, of the belt to be correctly reflected in the cleaning bias.

In particular, as the current value is measured a plurality of times and is averaged, it is possible to eliminate high frequency fluctuations of measured values, making it possible to obtain stabilized measured values.

Further, as the cleaning bias is determined by using the current value previously measured and previously stored, even in a case where there has been no timing for measuring the current value for some time (for example, after starting image forming and before measuring the current), it is possible to determine an optimum cleaning bias as practically as possible.

The invention can be utilized in various forms, as illustrated below, without being limited to the above-described embodiments.

Although in the above-described embodiments a description has been given under the premise that the toner is positively charged, the polarity of each bias is appropriately set to be the opposite of the charging quality of the toner, and the charged state of the belt also changes correspondingly. Additionally, not only the polarity but the magnitude of each bias can also be set appropriately.

Although in the above-described embodiments the invention has been described with reference to a color printer of the so-called tandem type as an example, embodiments of the present invention are also applicable to a color printer of the so-called 4-cycle type.

Although in the embodiments the exposure of the photoconductor drum 53 is effected by LEDs, the exposure may alternatively effected by scanning with a laser. In addition, although an example has been illustrated in which each switch is open in the state in which the bias is in the OFF state, it is possible to use a power supply in which the output becomes 0V when the bias is OFF. Further, the ammeter may be provided on the power supply side.

What is claimed is:

1. An image forming apparatus comprising:

an endless belt;

a plurality of image carriers juxtaposed along an outer peripheral surface of the belt;

a plurality of transfer members which are respectively provided in correspondence with the image carriers, which are respectively disposed opposite the image carriers with the belt interposed therebetween, and configured to receive application of a first bias;

a cleaning member disposed in contact with the outer peripheral surface of the belt;

a current sensor configured to measure a value of electric current flowing across the cleaning member; and a controller configured to control a second bias, which is applied to the cleaning member based on the value of the electric current measured by the current sensor, wherein the controller is configured to control the second bias based on the value of the electric current measured when a predetermined measurement range of the belt is in contact with the cleaning member, and wherein the measurement range is a range in which conditions, under which the first bias and the second bias are applied, are identical.

2. The image forming apparatus according to claim 1, wherein the measurement range in which the conditions, under which the first bias and the second bias are applied, are identical is a range in which, both the first bias and the second bias have not been applied.

3. The image forming apparatus according to claim 1, wherein the measurement range in which the conditions, under which the first bias and the second bias are applied, are identical is a range in which the first bias has not been applied and the second bias has been applied a predetermined number of times.

4. The image forming apparatus according to claim 1, wherein the measurement range in which the conditions,. under which the first bias and the second bias are applied, are identical is a range in which the first bias has been applied a predetermined number of times.

5. The image forming apparatus according to claim 1, wherein the measurement range is set to a range in which the belt is disposed opposite to the cleaning member after a predetermined time duration has lapsed since the belt was driven and the second bias was applied.

6. The image forming apparatus according to claim 1, wherein the measurement range is set to a range in which the belt is disposed opposite to the cleaning member after a predetermined time duration has lapsed since the belt was driven and the first bias was applied.

7. The image forming apparatus according to claim 1, wherein the measurement range is set to a predetermined range offset in a backward direction by a predetermined length of the belt, in the advancing direction, from a reference position on the belt disposed opposite the cleaning member when the belt is driven and the second bias is applied.

8. The image forming apparatus according to claim 1, wherein the measurement range is set to a predetermined range offset in a backward direction by a predetermined length of the belt, in the advancing direction, from a reference position on the belt disposed opposite the transfer member when the belt is driven and the first bias is applied.

9. The image forming apparatus according to claim 1 further comprising a third bias application member configured to apply a third bias to the belt, wherein the measurement range is a range in which conditions, under which the first, second and third bias are applied, are identical.

10. The image forming apparatus according to claim 9, wherein the third bias application member is provided at a backside of the transfer member in the advancing direction and comprises a roller configured to nip a recording sheet in cooperation with the belt.

11. The image forming apparatus according to claim 1, wherein the controller is configured to control the second bias based on a value obtained by averaging a plurality of values of current measured at the measurement range.

12. The image forming apparatus according to claim 1, wherein, after starting image forming and before measuring the current, the controller is configured to control the second bias based on the value of current previously measured by the current sensor.

13. The image forming apparatus according to claim 1, wherein the belt is configured to transfer a recording sheet.

14. The image forming apparatus according to claim 1, wherein the belt comprises an intermediate transfer belt having an outer peripheral surface on which a toner image is formable from the plurality of image carriers, the image forming apparatus further comprises a secondary transfer roller configured to nip a recording sheet in cooperation with the intermediate transfer belt and to apply a fourth bias to transfer the toner image on the intermediate transfer belt to the recording sheet, and the measurement range is a range in which conditions, under which the first, second and fourth bias are applied, are identical.

15. A method of controlling an image forming apparatus, the method comprising:

measuring a value of electric current flowing across a cleaning member disposed in contact with an outer peripheral surface of an endless belt of the image forming apparatus, the image forming apparatus further comprising a plurality of image carriers juxtaposed along the outer peripheral surface of the belt and a plurality of transfer members which are respectively provided in correspondence with the image carriers, which are respectively disposed opposite the image carriers with the belt interposed therebetween, and configured to receive application of a first bias; and controlling a second bias, which is applied to the cleaning member based on the measured value of the electric current when a predetermined measurement range of the belt is in contact with the cleaning member wherein the measurement range is a range in which conditions, under which the first bias and the second bias are applied, are identical.

* * * * *